United States Patent [19]

Off et al.

[11] 4,451,318

[45] May 29, 1984

[54] SYSTEM FOR PREFABRICATING POCKET WELTS AND FACING STRIPS

[75] Inventors: Joseph W. A. Off, Irving; Judson H. Early, Dallas, both of Tex.

[73] Assignee: Haggar Company, Dallas, Tex.

[21] Appl. No.: 304,095

[22] Filed: Sep. 21, 1981

[51] Int. Cl.[3] ..... B26D 5/00; B32B 31/00; B32B 31/04; A41D 11/00

[52] U.S. Cl. ..... 156/353; 156/356; 156/361; 156/366; 156/552; 2/243 B

[58] Field of Search ..... 156/358, 361, 557, 583.1, 156/DIG. 21, DIG. 36, 362, 363, 543, 552, 355, 354, 356, 379.8, 353, 366, 478, 479, 480, 512, 510, 541, 558, 566; 2/247, 243 B; 29/430

[56] References Cited

U.S. PATENT DOCUMENTS

| | | | |
|---|---|---|---|
| 2,523,389 | 9/1950 | Oskow | 156/DIG. 21 |
| 3,708,372 | 1/1973 | Contreras | 156/361 |
| 4,093,493 | 6/1978 | Welch et al. | 156/358 |
| 4,141,775 | 2/1979 | Williams et al. | 156/358 |
| 4,226,661 | 10/1980 | Off et al. | 156/358 |
| 4,263,678 | 4/1981 | Off | 2/247 |
| 4,301,958 | 11/1981 | Hatakenaka et al. | 29/430 |
| 4,316,756 | 2/1982 | Wilson | 2/247 |
| 4,328,062 | 5/1982 | Off et al. | 156/583.1 |

*Primary Examiner*—Edward C. Kimlin
*Assistant Examiner*—Louis Falasco
*Attorney, Agent, or Firm*—Richards, Harris & Medlock

[57] ABSTRACT

In a system (10) for prefabricating strings of pocket facing strips and welts on a continuous basis, the assembly proceeds in parallel along opposite sides of a table (12). Along the facing strip fabrication portion (18) of the system (10), adhesive backed tape (28) from a supply reel is directed to a bonding station (84) where facing strips (108) are positioned and adhesively attached to the tape, after which the tape and attached facing strips are wound onto a takeup reel. In the welt fabrication portion (20) of the system (10), adhesive backed tape (48) from a supply reel is indexed along a feedpath to a bonding station (84') where sections of fabric (154) are positioned and adhesively secured to the tape. From there the tape (48) is indexed to an adhesive application station (172) where adhesive (174) is applied to the top surface of the tape, after which each fabric section (154) is folded over and adhesively secured to the tape at a folding/bonding station (230) prior to collection on a takeup reel.

19 Claims, 17 Drawing Figures

154
171
150
152
48
20
72
156
170
158
166
160
162
168
164
110'
86'
132'
138'
124'
126'
130'
120'
122
112'
92'
96'
90'
98'
106'
100'
84'
94'
88'
82'
80'
78'
9
14
50
72'
110'
88'

SYSTEM FOR PREFABRICATING POCKET WELTS AND FACING STRIPS

TECHNICAL FIELD

The present invention relates generally to a system for manufacturing garment components, and more particularly to an apparatus and method for continuously prefabricating separate strings of interconnected, spaced apart welts and facing strips for use in constructing pockets in garments.

BACKGROUND ART

The manufacture of garments traditionally has been characterized by various manual operations including material cutting, positioning, sewing and trimming. Such manual operations are both time consuming and expensive in terms of their contribution to the overall cost of manufacturing a garment. For example, a significant portion of the production cost of a pair of trousers, shorts or a jacket can be attributed to the expense associated with constructing and finishing the pockets therein. Since the garment industry is characterized by high volume production, it will be appreciated that the cost of fabricating garment components such as pockets, belt loops, epaulets, waist bands and the like represents considerable expense.

In an attempt to improve upon the manual sewing techniques of the prior art, efforts have been directed toward automating various aspects of garment fabrication and incorporating adhesive as a supplement or complete substitute for mechanically sewn stitches. For example, U.S. Pat. Nos. 3,880,697 and 3,993,526 relate to a system for making bonded belt loops in which strips of belt loop material and interfacing material are transported through a folder and around a revolving heated drum which activates adhesive on the interfacing material to form bonded belt loops. U.S. Pat. No. 4,156,293 discloses a pocket construction wherein a garment panel and rectangular pocket blank are secured together and manually formed into a finished pocket through various folding and adhesive connection steps. U.S. Pat. No. 4,226,661 shows an apparatus for manufacturing on a continuous basis prefabricated pocket bags like that shown in the aforementioned '293 patent. U.S. Pat. No. 4,315,793, discloses an apparatus for integrating prefabricated pocket bags into garment panels on a semi-automatic basis wherein each pocket bag and corresponding garment panel are releasably clamped together and manually advanced through various work stations. Co-pending application Ser. No. 170,750 discloses an apparatus for transporting and indexing a plurality of sets of garment panels and prefabricated pocket bags through various work stations to form garments panels with finished pockets constructed therein. All of these inventions are assigned to Haggar Company of Dallas, Tex.

A good deal of developmental work thus has been directed toward reducing the cost associated with constructing belt loops and especially pockets of garments, with comparatively little attention having been focused upon the remaining component elements of the pockets. Although adhesive connection techniques have been employed in general heretofore, the construction of pocket welts and facing strips has been carried out manually and thus has still contributed significant expenses to the cost of constructing the pockets themselves. A system is therefore needed which automatically prefabricates continuous strings of pocket welts and facing strips for subsequent use in the pocket construction stage of garment manufacture.

SUMMARY OF INVENTION

The present invention comprises a system for prefabricating garment components which overcomes the foregoing and other difficulties associated with the prior art. In accordance with the invention, there is provided an apparatus and method for assembling on a continuous basis strings of pocket welts and facing strips for subsequent use in constructing of pockets in garment panels. This system is particularly adapted to serve, along with the one shown in U.S. Pat. No. 4,226,661, as a peripheral support device to an apparatus for automatically constructing pockets in garment panels.

More particularly, the present invention comprises a system for prefabricating continuous strings of pocket welts and facing strips on a semi-automatic basis. Welts are fabricated on one side of the apparatus, with facing strips being fabricated on the opposite side. A supply roll of tape with adhesive on one side thereof is provided for each side of the apparatus. Each tape is withdrawn from the supply reel and indexed to a bonding station where a section of fabric is positioned beneath the tape by an operator before the tape and fabric section are adhesively connected and bonded together. Separate transfer assemblies index the tapes. The string of facing strips on one tape, which is completed as each section of fabric is attached to the tape, is wound onto a takeup reel. The semifinished welts on the other tape are first advanced through a cutter to trim each section of fabric and then through an adhesive application/folding station to fold the fabric around the tape and adhesively secure it in place and thus complete formation of the string of pocket welts before being wound onto another takeup reel.

BRIEF DESCRIPTION OF DRAWINGS

A more complete understanding of the invention can be had by referring to the following Detailed Description together with the accompanying Drawings, wherein.

DETAILED DESCRIPTION

Figure 1:
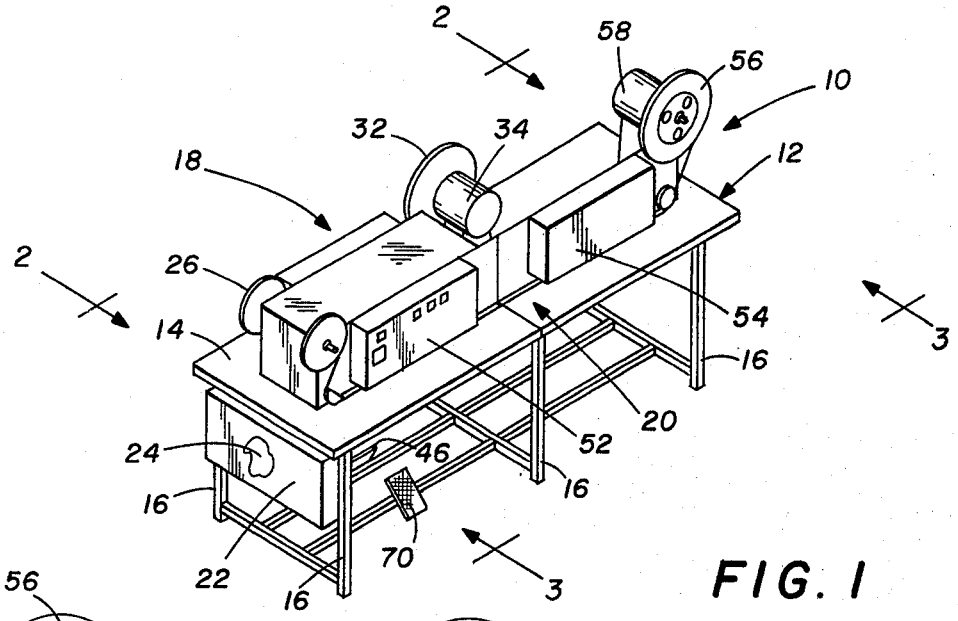
FIG. 1 is a perspective view of a system for prefabricating welts and facing strips incorporating the inventions.
Figure 2:
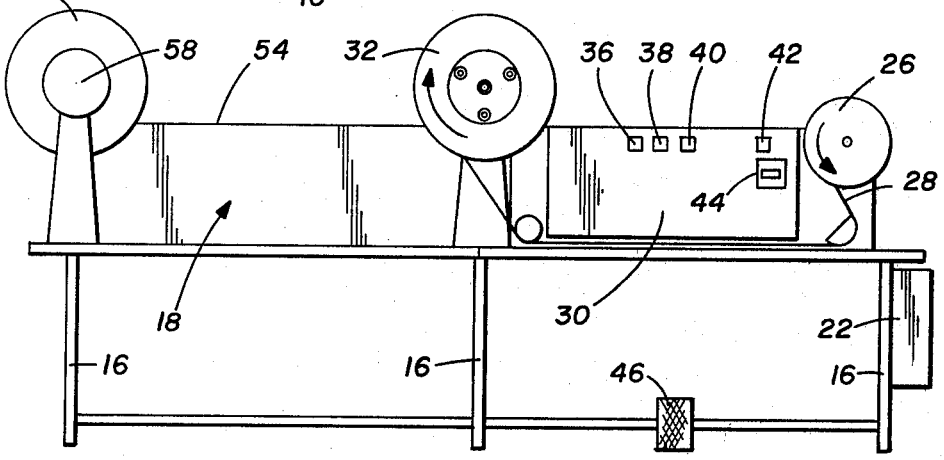
FIG. 2 is a reduced elevational view of one side of the system.
Figure 3:
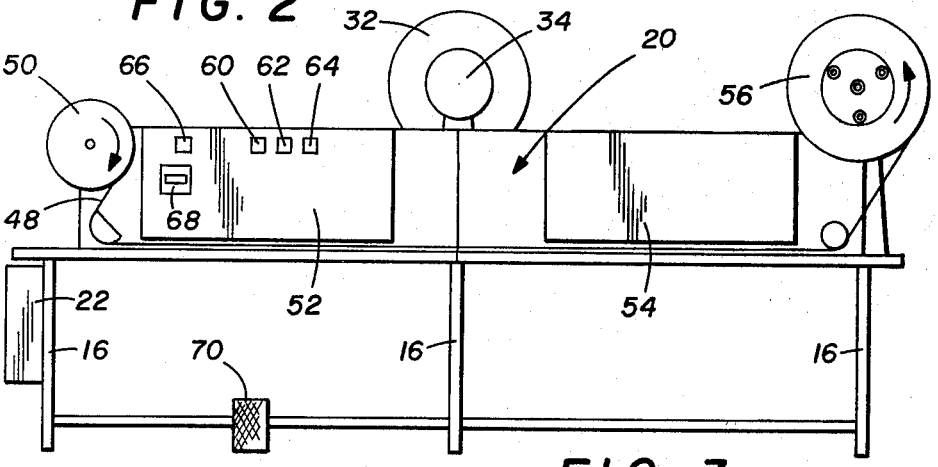
FIG. 3 is a reduced elevational view of the other side of the system.

Referring now to the Drawings, wherein like reference numerals designate corresponding elements throughout the views, and particularly referring to FIGS. 1-3, there is shown the system 10 incorporating the invention. System 10 is particularly adapted for continuous, semiautomatic fabrication of strings of pocket welts and facing strips which are then integrated with pocket bags to form finished pockets in garment panels.

System 10 is mounted on a table 12 comprising a top 14 supported by legs 16. The facing strip fabrication assembly 18 is located along one side of table 12 while the welt fabrication assembly 20 is located along the other side. Strings of facing strips or strings of welts alone can be fabricated with system 10, as can both strings of welts and facings strips simultaneously. Each side of system 10 thus comprises an important aspect of the invention. A cabinet 22 is located at the forward end of table 12 for housing a microprocessor 24 which controls system 10. Microprocessor 24 can comprise an Intel Model 4004 or Zilog Z-80 microprocessor controller.

FIG. 2 is a general elevational view of the facing strip fabrication assembly 18 of system 10. A supply reel 26 of adhesive-backed paper tape 28 is located at the front end of the assembly. Tape 28 from reel 26 is withdrawn and directed along a path through work stations behind cover 30 to secure sections of fabric to the tape before being wound onto a takeup reel 32. Motor 34 drives takeup reel 32. Four buttons, 36, 38, 40 and 42 and a counter 44 are located on cover 30 for use by an operator standing adjacent to that side of table 12. Button 36 is utilized when threading tape 28 between reels 26 and 32 to initiate assembly 18 for operation. Button 38 comprises a stop button for deactivating assembly 18 of system 10 in the event of a hangup or other emergency. Button 40 is utilized to jog tape 28 forward as desired, while the motor 34 of the takeup reel 32 is controlled with button 42. A foot switch 46 is provided beneath table 12 for use by the operator in controlling advancement of tape 28 through assembly 18.

FIG. 3 is a general elevational view of the welt fabrication assembly 20 of system 10 which, at the forward end thereof, is similar in some respects to assembly 18. Adhesive backed fabric tape 48 from a supply roll 50 is directed along a path between bonding, advancing, trimming, adhesive applicating, and folding/bonding stations located behind covers 52 and 54 to a takeup reel 56 which is driven by motor 58. A thread button 60, stop button 62, jog button 64 and motor on/off button 66 together with a counter 68 are provided on cover 52 for use by the operator of assembly 20 in similar fashion to the buttons and counter of assembly 18 on the opposite side of system 10. A foot switch 70 controls advancement of tape 48 through assembly 20.

Figures 4, 7:
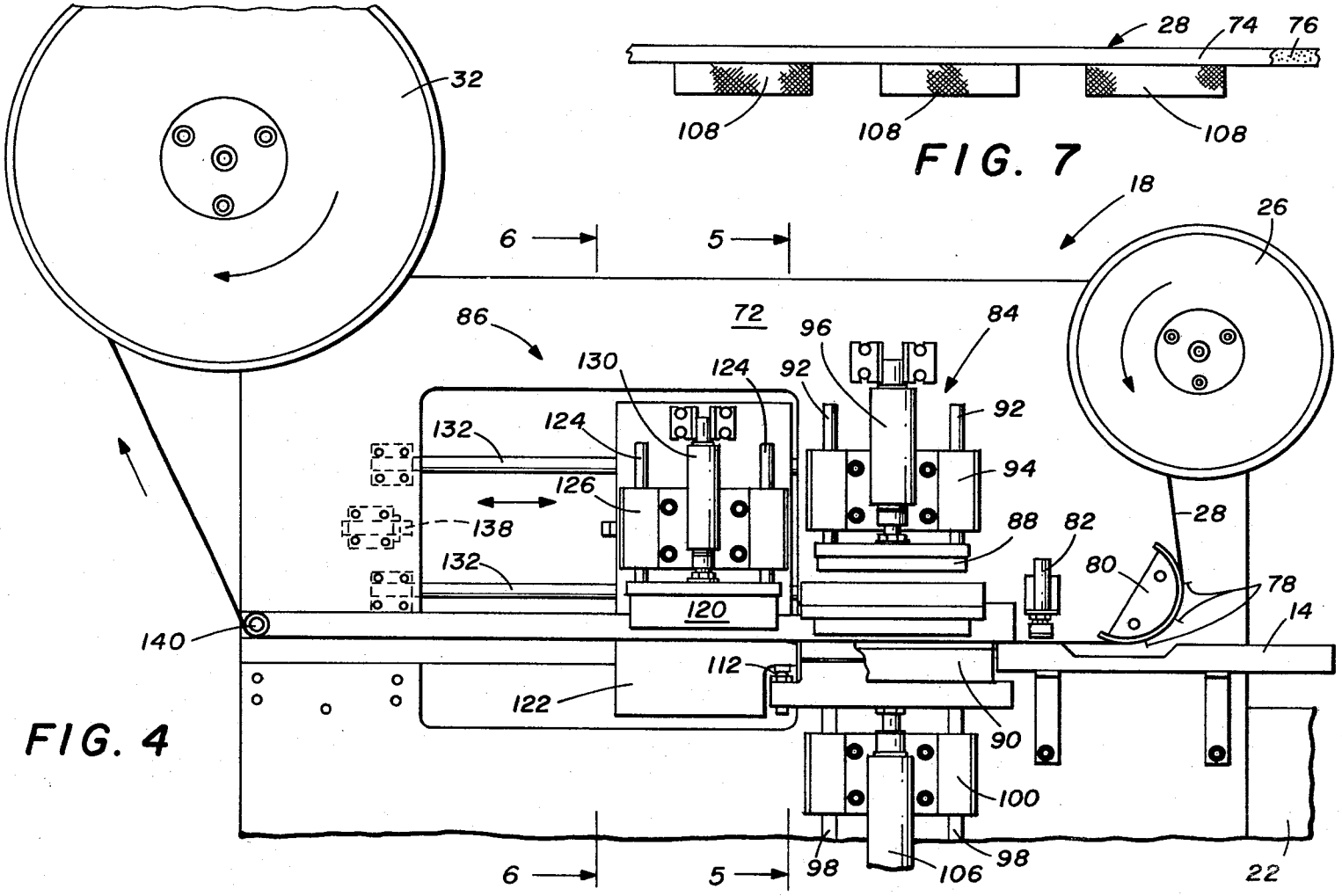
FIG. 4 is an enlarged illustration, partially cut away, of FIG. 2 showing the facing strip assembly portion of the system.
FIG. 7 is an illustration of a portion of a completed string of facing strips.

The structural details of the facing strip fabrication assembly 18 are illustrated in FIGS. 4-7. Cover 30 has been entirely omitted from FIG. 4 for clarity. The various components of assembly 18 are mounted on either the top 14 of table 12 or on a support plate 72 extending upwardly therefrom. A supply reel 26 of tape 28 is mounted for rotation at the forward end of plate 72. Tape 28 comprises a strip of paper 74 with a coating of fusible adhesive 76 on the underside thereof as is best seen in FIG. 7. Adhesive 76 can comprise nylon, polyester, polyamide, plastic or other fusible substances characterized by temporary conversion to a plastic state from a solid state upon heating. Tape similar to tape 28 can be obtained from General Fabric Fusing Company of Cincinnati, Ohio.

The adhesive backed paper tape 28 is withdrawn from supply reel 26 and fed through loops 78 on the periphery of a fixed semicircular guide 80 as is best seen in FIG. 4. From guide 80, the tape 28 extends along a straight path beneath a tape clamp 82 which comprises a resilient foot actuated by a pneumatic cylinder. Clamp 82 functions to immobilize tape 28 against the table top 14 between advancements of the tape to achieve more precise control of tape withdrawal from supply reel 26. Clamp 82 is thus mounted above the path of tape 28 and is supported by a bracket attached to plate 72.

Tape 28 extends from clamp 82 beneath a bonding subassembly 84 and then a transfer subassembly 86. Subassembly 84 includes a cooperating head 88 mounted for vertical movement relative to an anvil 90 located on the opposite side of the tape path. Steel, aluminum, molded rubber or other suitable material can be utilized to fabricate head 88 and anvil 90. Head 88 is attached to the ends of a pair of rods 92 which are guided for movement in a block 94 attached to plate 72. Double acting cylinder 96 is coupled to head 88 for selective reciprocation thereof.

In accordance with the preferred construction, head 88 includes an internal electrical resistance element 98 and a temperature sensor or thermocouple 100 for heating the head in a controlled manner in order to activate the adhesive 76 of tape 28 upon engagement therewith. In the alternative, head 88 could be provided with an internal ultrasonic or radio frequency source, or an external source of radiation or heat could be positioned adjacent to the head for selectively activating sections of adhesive 76 on tape 28.

The backup anvil 90 of the bonding subassembly 84 is mounted in an opening in the table top 14. Anvil 90 can be fixed; however, in the preferred embodiment, the anvil is mounted for vertical movement relative to head 88. Anvil 90 is attached to the ends of a pair of rods 102 extending through a guide block 104 attached to plate 72. Reciprocation of anvil 90 is carried out by a double acting cylinder 106 coupled thereto. Anvil 90 is normally located in a recessed position beneath table top 14 to provide sufficient clearance for the operator to insert a strip of fabric comprising a facing strip 108 underneath tape 28 and against a locator block 110. Fabric strip 108 can be of either natural or synthetic material. The anvil 90 is shown in a raised position in FIG. 5, and an adjustable stop 112 is provided for limiting upward travel of the anvil.

After tape 28 has been threaded through loops 78 and around guide 80, through subassemblies 84 and 86 and onto takeup reel 32, the facing strip fabrication assembly 18 of system 10 is ready for operation. Clamp 82 is normally down, except during advancements of tape 28 by transfer subassembly 86, to prevent uncontrolled withdrawal of the tape from supply reel 26. The operator manually places a facing strip 108 on anvil 90 against block 110 and underneath tape 28, the adhesive side of which is down. The operator then activates foot switch 46 causing the bonding subassembly 84 to cycle. Anvil 90 thus raises facing strip 108 into contact with the adhesive side of tape 28 while head 88 comes down into engagement with the other side of the tape to clamp the facing strip and tape together under sufficient pressure and for adequate time to effect adhesive connection. After head 88 and anvil 90 return to their normal positions, tape 28 is ready for indexing and attachment of the next following facing strip 108 thereto.

Figure 5:
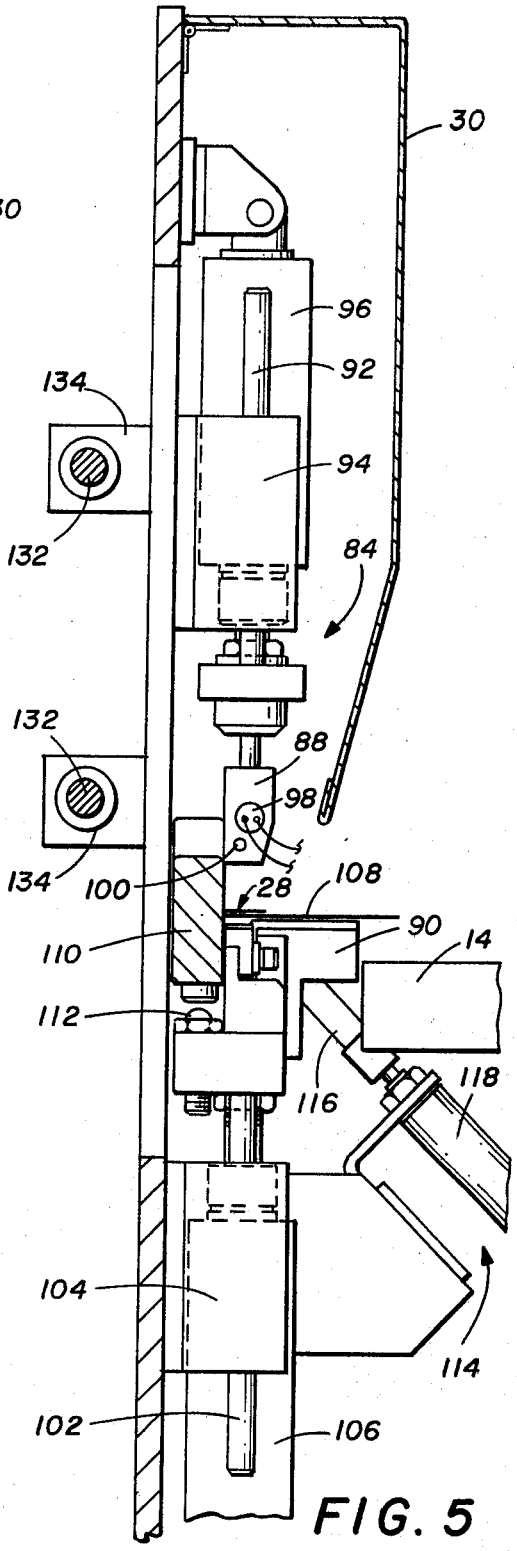

If desired, an optional alignment assembly 114 can be provided on one or both sides of anvil 90 as shown in FIG. 5. Assembly 114 comprises a flat blade 116 driven by a double acting cylinder 118 for movement relative to the tape path. Assembly 114 is oriented such that the plane of blade 116 is substantially perpendicular to the plane of tape 28 in order to insure that the tape is firmly located against block 110 during the bonding operation. The use of assembly 114, however, is optional and is not critical to practice of the invention.

Figure 6:
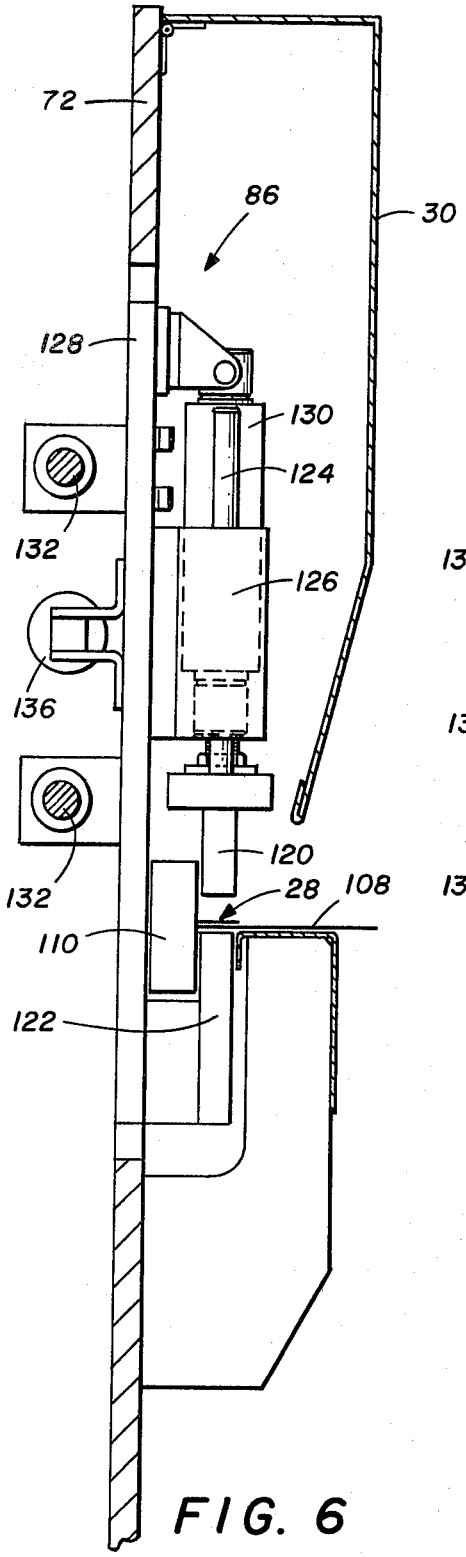
FIGS. 5 and 6 are sectional views taken along lines 5—5 and 6—6, respectively, of FIG. 4 in the direction of the arrows.

Advancement of tape 28 is effected by the transfer subassembly 86, the structural details of which are best seen in FIGS. 4 and 6. Subassembly 86 comprises a clamp bar 120 and backup anvil 122 mounted for reciprocation along the tape feedpath. The unheated clamp bar 120 is attached to the ends of a pair of rods 124 which are guided for vertical movement in a block 126 secured to a plate 128. A double acting cylinder 130 drives the clamp bar 120. Plate 128 is mounted for sliding movement along a pair of rods 132 extending between pairs of blocks 134 secured to plate 72. Coupled between plates 72 and 128 is a double acting cylinder 136 which functions to effect reciprocation of subassembly 86 within the opening in plate 72. An adjustable stop 138, as is best seen in FIG. 4, is provided to limit travel of the transfer subassembly 86.

Foot switch 46 controls the transfer subassembly 86 as well as the bonding subassembly 84 of facing strip fabrication assembly 18. After head 88 and anvil 90 of subassembly 84 have returned to their original positions, cylinder 130 is activated to clamp the leading end of tape 28 and the edge of any facing strip 108 secured thereto between bar 120 and anvil 122, after which tape clamp 82 is released and cylinder 136 is activated to index tape 28 forward. At the end of the stroke of cylinder 136, cylinder 130 releases clamp bar 120 while tape clamp 82 is again applied before the transfer subassembly 86 returns to its original position in preparation for the next cycle. The leading end of tape 28 with facing strips 108 bonded thereto is thus drawn around roller 140 and wound onto the takeup reel 32 by motor 34 as a new section of tape is drawn from supply reel 26 and positioned beneath the bonding subassembly 84 for attachment of another facing strip.

The structural details of the welt fabrication assembly 20 are illustrated in FIGS. 8a–15. Covers 52 and 54 have been entirely omitted from FIGS. 8a and 8b for clarity. As stated hereinbefore, the forward end of assembly 20 is similar in some respects to the forward end of the facing strip fabrication assembly 18 on the other side of system 10. In fact the leading ends of both assemblies 18 and 20 utilize numerous component parts which are similar in construction and operation. These component parts of assembly 20 have been designated with the same reference numerals utilized in the description of assembly 18, but are distinguished therefrom by means of prime (') notations.

Figures 8A, 9, 10:
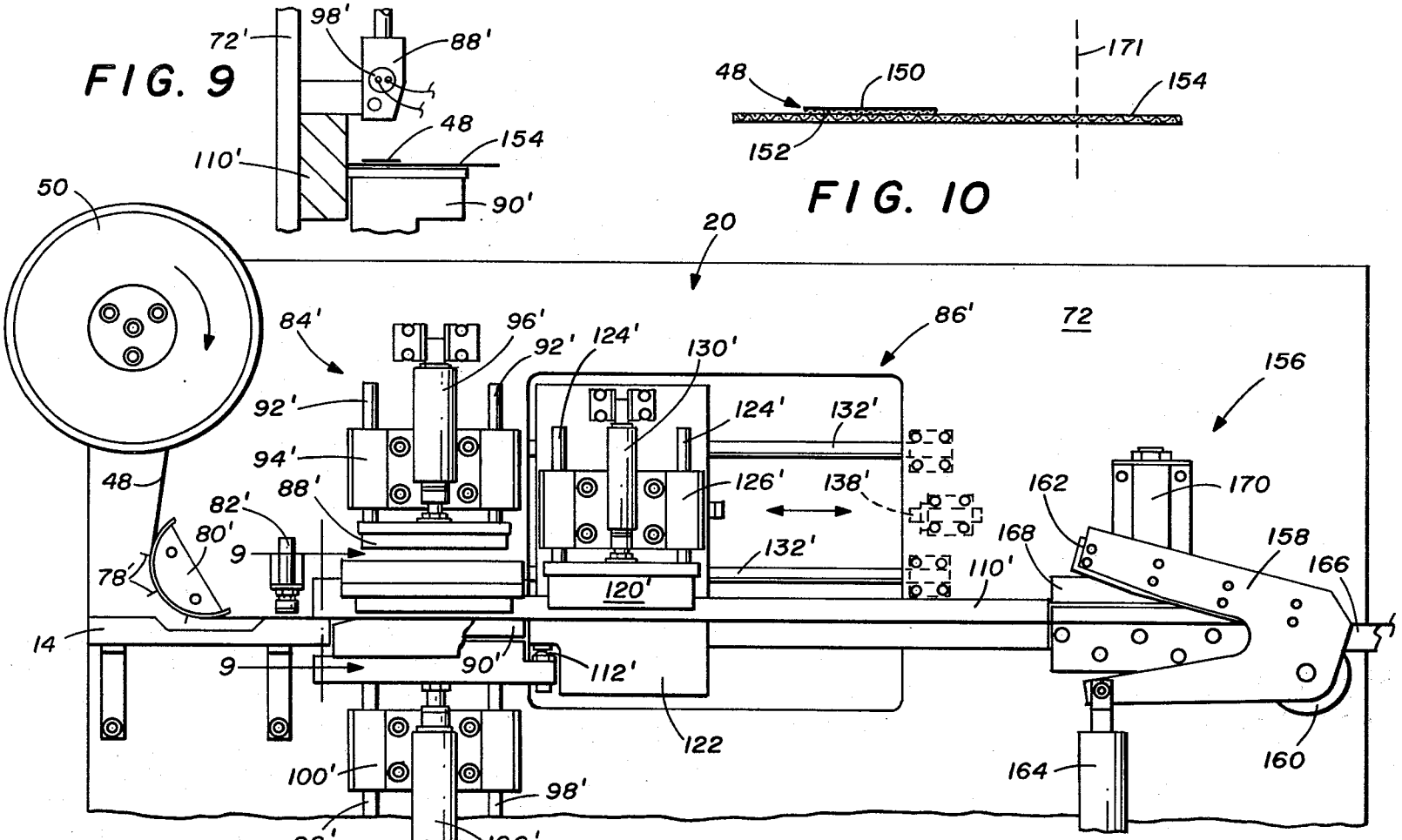
FIGS. 8*a* and 8*b* are enlarged illustrations of FIG. 3 showing the pocket welt formation portion of the apparatus.
FIG. 9 is a sectional view taken along lines 9—9 of FIG. 8*a* in the direction of the arrows.
FIG. 10 is an enlarged cross-sectional illustration of a semi-complete string of pocket welts entering the timing station.

Adhesive backed tape 48 is withdrawn from supply reel 50 and fed through loops 78', around guide 80', beneath tape clamp 82' and through subassemblies 84' and 86' of assembly 20 in much the same fashion as is done in assembly 18. Tape 48, however, preferably comprises a strip of fabric 150 with a coating of fusible adhesive 152 on the underside thereof as is best shown in FIG. 10. Fabric 150 can be either natural or synthetic material. Adhesive 152 can comprise nylon, polyester, polyamide, plastic or other fusible substance characterized by temporary conversion from a solid state to a plastic state upon heating. Tape similar to tape 48 can be obtained from General Fabric Fusing Company of Cincinnati, Ohio.

The strips of fabric 154 from which the welts are formed, as will be explained more fully hereinafter, are positioned by the operator on anvil 90' underneath tape 48 and against the locator block 110' such that the fabric protrudes from the inner longitudinal side of the tape as can be seen in FIG. 9. The inner longitudinal edges of the strips of fabric 154 and tape 48 are thus not substantially flush as are the same edges of tape 28 and strips 108 of the facing strip fabrication assembly 18. Each strip of fabric 154 can protrude, for example, about one quarter of an inch beyond the inner edge of tape 48.

As the strips of fabric 154 are attached to tape 48, the transfer subassembly 86' incrementally advances the tape and strips through the other work stations of assembly 20, the first of which is the trimming station 156 in the preferred embodiment of the system. Station 156 comprises a V-shaped knife carrier 158 secured at one end to a pivot 160 attached to support plate 72'. A blade 162 is attached to one end of carrier 158, while a double acting cylinder 164 is coupled to the other end thereof. Tape 48 and the fabric strips 154 bonded thereto are advanced onto a support surface 166 and clamped in place with a reciprocal bar 168 driven by a double acting cylinder 170. While tape 48 is thus immobilized, cylinder 164 is actuated to pivot knife carrier 158 such that blade 162 shears the outer edge of each fabric strip 154 across the edge of the support surface 166. The dotted line 171 in FIG. 10 represents the shear line of fabric strip 154. Clamp 168 and knife carrier 158 are then returned to the position shown in FIG. 8a in preparation for the next advancement of tape 48. The trimming station 156 thus operates only between advancements of tape 48, and is preferably located an incremental distance from the bonding subassembly 84' so that each advancement of the tape properly positions the next fabric strip 154 for trimming.

If desired, narrower fabric strips 154 could be utilized and the trimming station 156 could be eliminated; however, the use of the trimming station permits rectangular fabric pieces of similar sizes to be used as either strips 108 in assembly 18 on strips 154 in assembly 20.

Figures 8B, 16:
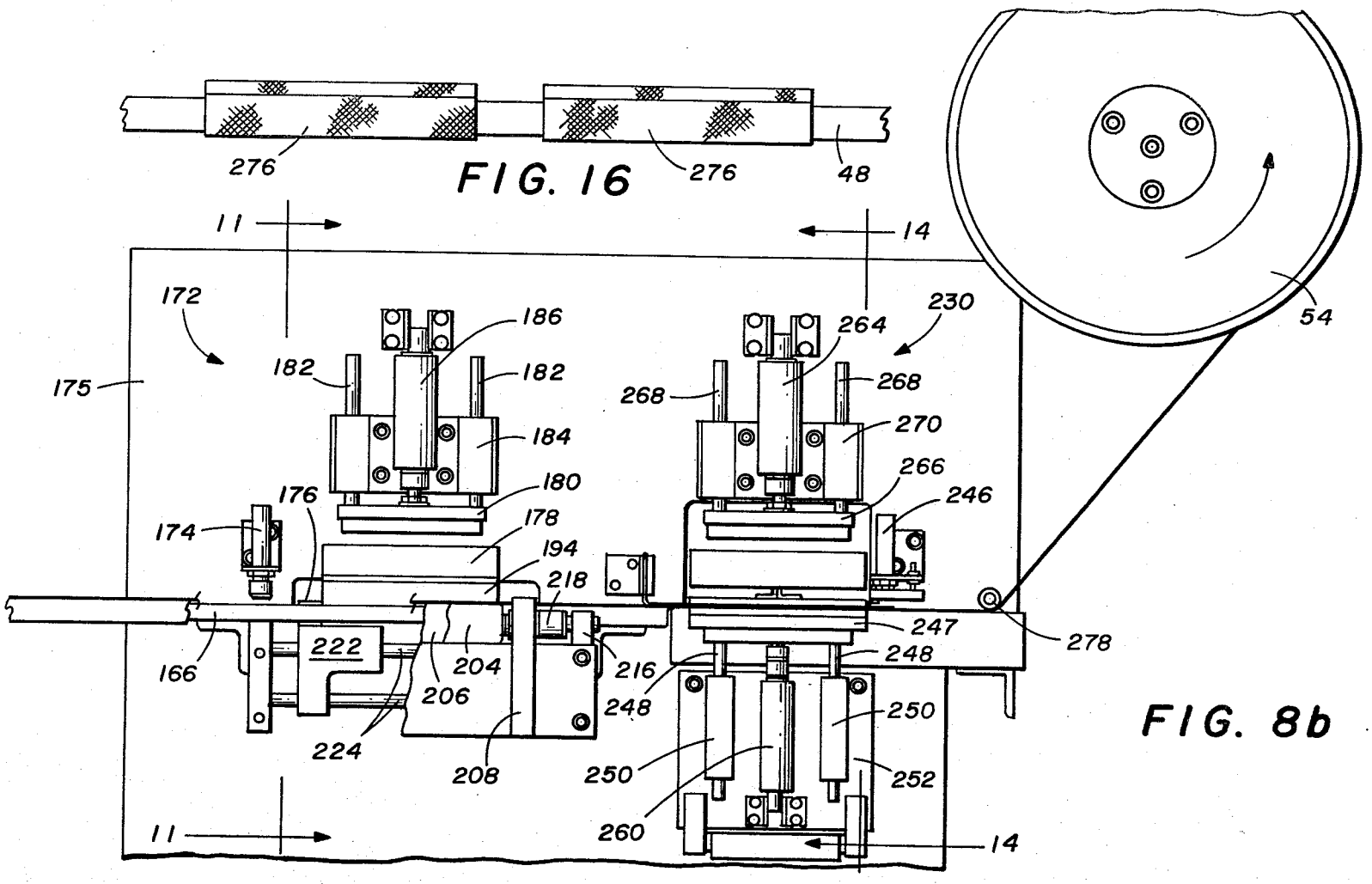
FIGS. 15 and 16 are cross-sectional and top illustrations of a portion of a completed string of pocket welts.
Figures 11, 12, 13:
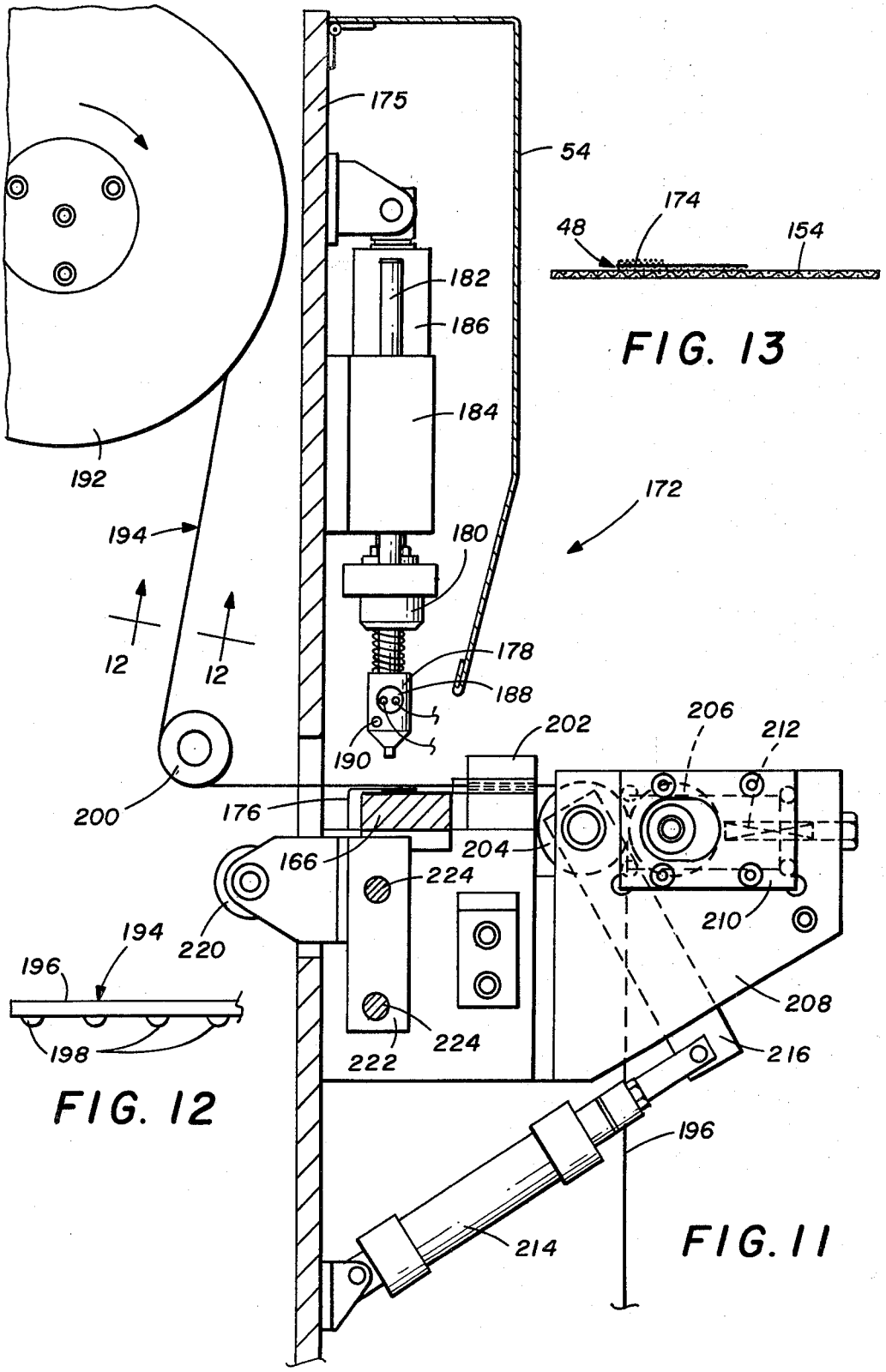
FIG. 11 is a sectional view taken along lines 11—11 of FIG. 8*b* in the direction of the arrows.
FIG. 12 is a sectional view taken along lines 12—12 of FIG. 11 in the direction of the arrows.
FIG. 13 is an enlarged cross-sectional illustration of a semi-complete string of pocket welts leaving the adhesive application station.

Referring now to FIGS. 8b, 11 and 12, the tape 48 and trimmed strips of fabric 154 attached thereto are advanced from the trimming station 156 to an adhesive application station 172. A strip of adhesive 174 is applied along one edge of the top side of the fabric 150 of tape 48. Tape 48 extends over a continuation of support surface 166 along a straight path beneath a tape clamp 374 and then beneath a stripper finger 176, which is mounted for movement along the path of the tape and which is positioned between the tape and a movable head 178. Clamp 374 comprises a resilient foot actuated by a double acting cylinder, and functions to immobilize the immediate section of tape when stripper finger 176 is actuated. Clamp 374 is thus mounted above the path of tape 48 and is supported by a bracket attached to a plate 175 which supports the other components of station 172.

As is best seen in FIG. 11, head 178 comprises an elongate generally rectangular member having a relatively narrow flat tip configured to engage a predetermined longitudinal zone along the top surface of fabric 150 of tape 48. Steel, aluminum, molded rubber or other suitable material can be utilized to construct head 178, which is resiliently supported by a bar 180 attached to the ends of a pair of rods 182 guided for movement in a block 184 attached to plate 175. Reciprocation of head 178 relative to the underlying support surface 166 is selectively effected with a double acting cylinder 186 coupled between bar 180 and plate 175.

In the preferred construction, head 178 includes an internal electrical resistance element 188 and a temperature sensor or thermocouple 190 for heating the head in a controlled manner in order to activate the adhesive 174 applied to the top surface of tape 48. In the alternative, head 178 could be provided with an internal ultrasonic or radio frequency source, or an external source of radiation or heat could be utilized with the head for selectively activating the adhesive 174 applied to tape 48 at station 172.

The longitudinal area of adhesive 174 added to the top surface of tape 48 is applied from a supply roll 192 of adhesive tape 194 mounted for rotation behind plate 175. Tape 194 comprises a strip of suitable carrier material 196, such as paper, with dots of fusible adhesive 198 attached to one side thereof, as is best seen in FIG. 12. The dots of adhesive 198 can be formed of nylon, polyester, polyamide, plastic or other fusible material characterized by temporary conversion from a solid state to a plastic state upon heating. Dot coated adhesive paper tape suitable for use as tape 194 can be obtained from Wendell Textile Company of Baltimore, Md.

The dot coated adhesive tape 194 is drawn from reel 192 around a guide roller 200 through an opening in plate 175, and from there between stripper finger 176 and reciprocal head 178. From that point tape 194 extends through a guide slot in block 202 and between a drive roller 204 and a nip roller 206. Rollers 204 and 206 are rotatably supported between a pair of brackets 208, only one of which is shown, and which also support the guide block 202. Drive roller 204 is rotatably supported in a fixed position between brackets 208, while nip roller 206 floats between a pair of carrier plates 210 attached to the brackets. Carrier plates 210 support the ends of nip roller 206 for rotation as well as movement relative to drive roller 204, and adjustable compression springs 212 are provided for urging the nip roller into firm engagement with the drive roller so that no slippage of tape 194 therebetween will occur.

Roller 204 is driven by a double acting index cylinder 214 through a crank arm 216 and a unidirectional clutch 218 which is coupled to one end of the shaft supporting the drive roller as is best seen in FIG. **8*b*. The stroke of cylinder 214 and the length of arm 216 are selected to provide a rotational drive input to roller 204 which advances the dot coated adhesive tape 194 sufficiently between successive fabric strips 154 on the tape. The index cylinder 214 thus cycles to advance the dot coated adhesive tape 194 as the fabric tape 48** is being advanced.

Cylinder 186 cycles between advancements of tapes 194 and 48 to transfer adhesive dots 198 from the backing 196 of the tape 194 onto the upper side of the fabric tape 48. Tapes 48 and 194 are then disconnected by the movable stripper finger 176, which is positioned between the tapes, as it moves along the fabric tape and across the adhesive dot coated tape under the action of the double acting cylinder 220 shown in FIG. 11. Cylinder 220 drives a sliding block 222 which is mounted on a pair of rods 224 and which supports the stripper finger 176. Tape clamp 374 is actuated immediately prior to and during actuation of the stripper finger 176 to stabilize the fabric tape 48. After the heated head 178, stripper finger 176 and tape clamp 374 have cycled tapes 48 and 194 can be advanced again in preparation for receiving the next strip of fabric 154. FIG. 13 illustrates tape 48 as it leaves station 172.

Referring now to FIGS. **8*b* and 14, the final station of the welt fabrication assembly 20 of system 10 comprises a bonding/folding station 230 wherein one side of each successive fabric strip 154 is folded over tape 48 and secured in place by means of adhesive 174. Tape 48 is advanced into position on a continuation of the support surface 166 and beneath both a fixed longitudinal stabilizer finger 232 and a movable head 234. The stabilizer finger 232 extends along the longitudinal edge of tape 48 opposite to that along which adhesive 174 is located, and functions as a longitudinal edge guide over which each successive strip of fabric 154** is folded.

Figures 14, 15:
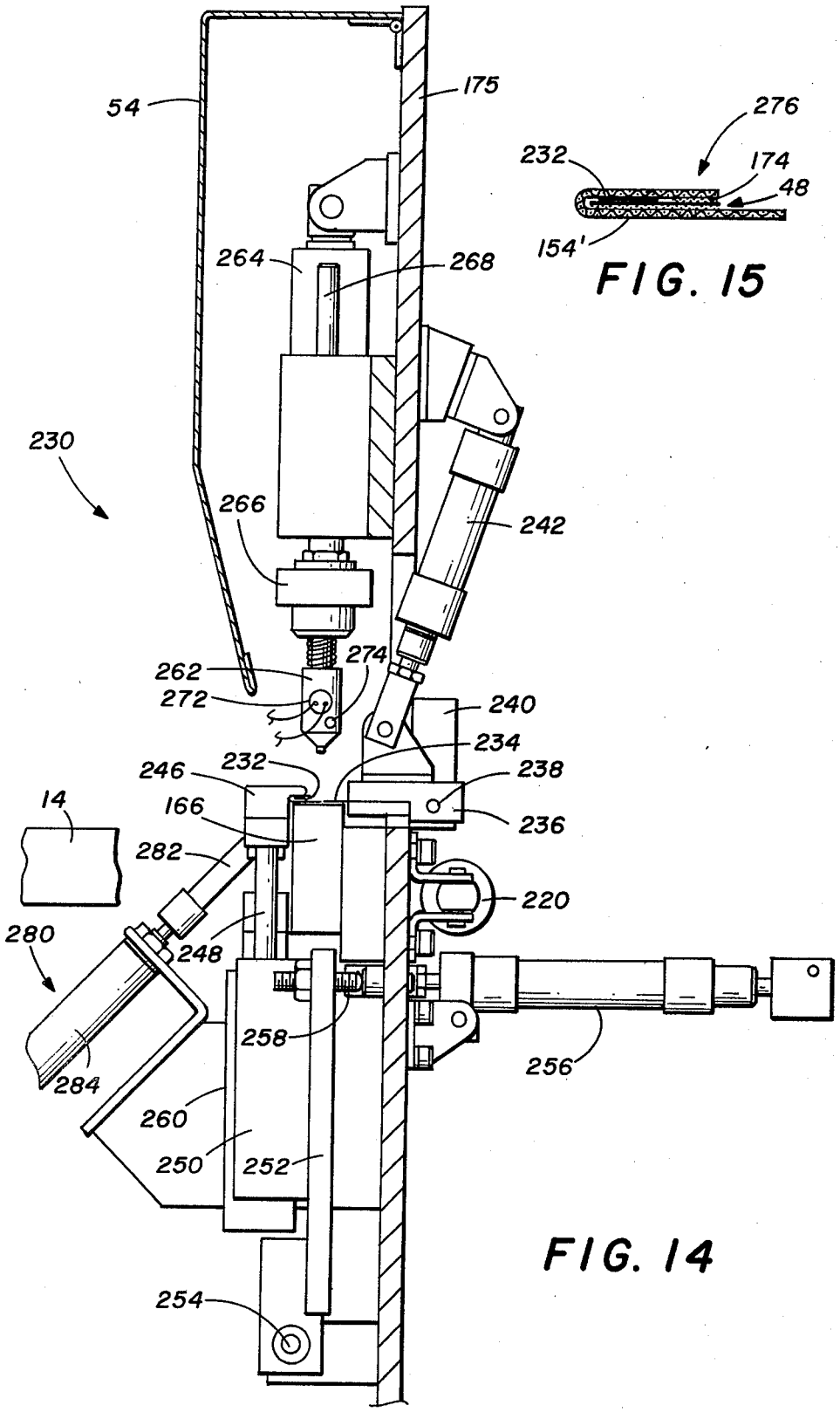
FIG. 14 is a sectional view taken along lines 14—14 of FIG. 8*b* in the direction of the arrows.

As tape 48 is indexed into station 230, a movable tongue clamp 234 comes down to firmly engage the narrow portion of each corresponding strip of fabric 154 against the underlying support surface 166. Tongue clamp 234 is attached to a block 236 which is connected by means of a pivot 238 to a bracket 240 secured to the back of plate 175 as is best seen in FIG. 14. A double acting cylinder 242 actuates tongue clamp 234. FIG. 14 shows the tongue clamp 234 in a down position against the strip of fabric 154 attached to tape 48. Finger clamp 246 is also actuated to stabilize the free end of finger 232. The finger clamp 246 comprises a resilient foot actuated by a double acting cylinder.

After tape 48 has been clamped in place by tongue clamp 234 and finger 232 has been releasably secured by the finger clamp 246, folder 247 is actuated to fold the wide side of the fabric strip 154 over the finger. Folder 247 comprises a generally inverted L-shaped member attached to the ends of a pair of rods 248, each of which is mounted for movement in a block 250 secured to a plate 252. Plate 252 is supported by pivot 254 on plate 175 for pivotal movement in a direction transverse to the path of tape 48. Lateral movement of folder 247 is controlled by a double acting cylinder 256 coupled between plates 175 and 252, and an adjustable stop 258 is provided for limiting lateral travel of the folder relative to tape 48. Cylinder 260 mounted on plate 252 controls vertical movement of the folder 247, which can thus be articulated both vertically and laterally relative to the tape. Normally, folder 247 is positioned outwardly with respect to tape 48. Once tape 48 is properly positioned and releasably clamped in place on the support surface 166, folder 247 is actuated upwardly by cylinder 260 and then inwardly by cylinder 256 before being actuated downwardly by cylinder 260 to fold one edge of the strip of fabric 154 over tape 48.

Once the fabric strip 154 has been folded over tape 48 and the adhesive 174 thereon, head 262 is actuated downwardly by cylinder 264 thereby activating the adhesive and bonding the folded fabric to tape 48 to complete formation of a welt. As in station 172, the head of station 230 is attached to the bottom ends of a pair of rods 268 mounted for movement in a guide block 270 secured to plate 175. Head 262 preferably includes an internal electrical resistance element 272 and associated temperature sensor or thermocouple 274 for heating the head in a controlled manner sufficient to activate the adhesive 174. Alternatively, an internal ultrasonic or radio frequency source, or an external source of radiation or heat could be utilized with head 272 for effecting activation of the adhesive. After head 262 has cycled, folder 247 is raised by cylinder 260 while finger clamp 246 and tongue clamp 234 are released permitting tape 48 and the welts thereon to travel around roller 278 and be wound on reel 56 by motor 58. FIGS. 15 and 16 illustrate tape 48 with completed welts 276 thereon as it leaves station 230.

With further reference to FIG. 14, station 230 can be provided with an optional alignment assembly 280 at either end of the folder 246 for locating tape 48 and each strip of fabric 154 thereon in proper position before the operational sequence of the station is initiated. Assembly 280, which includes a movable blade 282 driven by a double acting cylinder 284, functions substantially similarly to assembly 114 described hereinbefore in connection with FIG. 5.

From the foregoing, it will be apparent that the present invention comprises a system for prefabricating strings of facing strips and welts which incorporates several advantages over the prior art. One important advantage involves the elimination of numerous manual operations which were heretofore required in the construction of such pocket components. Placement of fabric strips under an adhesive tape is the only manual step required during operation of the system herein. The strings of uniformly spaced pocket facing strips and welts so fabricated are particularly adapted for use in the automatic implantation of pockets into garment panels. Other advantages of the invention will be evident to those skilled in the art.

Although particular embodiments of the invention have been illustrated in the accompanying Drawings and described in the Detailed Description above, it will be understood that the invention is not limited to the embodiments disclosed, but is intended to embrace any alternatives, modifications and/or substitutions of elements falling within the scope of the invention as defined by the following claims.

We claim:

1. Apparatus for securing fabric segments forming facing strips to a strip of fusible adhesive-backed tape comprising;

a supply reel having a length of fusible adhesive-backed tape thereon;

a take-up reel for receiving tape from the supply reel;

guide means extending between the supply reel and the take-up reel for guiding the tape therebetween with the adhesive layer of the tape facing downwardly;

drive means for actuating the take-up reel to continuously exert a force on the tape tending to move the tape along the guide means from the supply reel toward the take-up reel;

clamping means located at a first point along the guide means situated relatively adjacent to the supply reel for normally preventing movement of the tape under the action of the drive means;

fabric attachment means located at a second point along the guide means downstream from the first point and comprising:

(a) a locator block adjacent the tape for positioning a fabric segment forming a facing strip in a predetermined orientation below the path of the tape in the guide means;

(b) an anvil normally positioned below a fabric segment situated adjacent said locator block;

(c) means for raising the anvil and thereby lifting the fabric segment upward into engagement with the fusible adhesive layer of the tape in the guide means;

(d) fusible adhesive actuator means normally positioned above the tape in the guide means; and (e) means for engaging the fusible adhesive actuating means with the tape at a point opposite the location of the raised anvil to clamp the tape and the fabric segment between the anvil and the fusible adhesive actuator means thereby actuating the fusible adhesive of the tape to bond the fabric segment to the tape;

tape advancing means positioned at a third point along the guide means downstream from the second point and comprising:

(a) opposed jaws positioned on opposite sides of the tape in the guide means;

(b) means for actuating the jaws to clamp the tape therebetween;

(c) means for moving the jaws and the tape clamped therebetween along the path of the tape in the guide means from the third point to a fourth point along the guide means downstream from the third point and relatively adjacent to the take up reel, the distance between the third and fourth points being indexed to provide a uniform separation between fabric segments on the tape; and means for releasing the clamping means when the tape advancing means is actuated to move the tape and the fabric segments attached thereto toward the take-up reel.

2. The apparatus according to claim 1 wherein the clamping means comprises:

a fixed member located on one side of the tape in the guide means;

a movable member mounted on the opposite side of the tape in the guide means; and fluid powered cylinder means for actuating the movable member to clamp the tape between the movable member and the fixed member.

3. The apparatus according to claim 1 wherein the means for raising the anvil and thereby lifting the fabric segment upwardly into engagement with the fusible adhesive layer on the tape in the guide means comprises fluid powered cylinder means.

4. The apparatus according to claim 1 wherein the fusible adhesive actuator means includes electrically powered heating means for actuating the fusible adhesive layer of the tape.

5. The apparatus according to claim 1 wherein the means for engaging the fusible adhesive actuator means with the tape at a point opposite the location of the raised anvil includes fluid powered cylinder means.

6. The apparatus according to claim 1 wherein the means for actuating the jaws of the tape advancing means comprises fluid powered cylinder means.

7. The apparatus according to claim 1 wherein the means for moving the jaws and the tape clamped therebetween of the tape advancing means comprises:

guide means supporting the jaws for movement between the third and fourth points along the path; and fluid powered cylinder means for moving the jaws back and forth along the guide means.

8. The apparatus according to claim 1 wherein:

the clamping means comprises a fixed member located on one side of the path of the tape in the guide means, a movable member located on the opposite side of the path of the tape in the guide means, and fluid powered cylinder means for actuating the movable member to clamp the tape between the movable member and the fixed member;

the means for raising the anvil comprises fluid powered cylinder means;

the fusible adhesive actuator means includes electrically powered heating means;

the means for engaging the fusible adhesive actuator with the tape includes fluid powered cylinder means;

the jaws actuating means of the tape advancing means includes fluid powered cylinder means; and the means for moving the jaws of the tape advancing means includes guide means supporting the jaws for movement between the third and fourth points along the path of the tape in the guide means, and fluid powered cylinder means for moving the jaws back and forth along the guide means.

9. Apparatus for securing fabric segments for forming pocket welts to a strip of fusible adhesive-backed tape comprising:

a supply reel having a length of fusible adhesive-backed tape thereon;

a take-up reel for receiving tape from the supply reel;

guide means extending between the supply reel and the take-up reel for guiding the tape therebetween with the adhesive layer of the tape facing downwardly;

drive means for actuating the take-up reel to continuously exert a force on the tape tending to move the tape along the guide means from the supply reel toward the take-up reel;

clamping means located at a first point along the guide means situated relatively adjacent to the supply reel for normally preventing movement of the tape under the action of the drive means;

fabric attachment means located at a second point along the guide means downstream from the first point and comprising:

(a) a locator block adjacent the tape for positioning a fabric segment in a predetermined orientation below the path of the tape in the guide means;

(b) an anvil normally positioned below a fabric segment situated adjacent said locator block;

(c) means for raising the anvil and thereby lifting the fabric segment upward into engagement with the fusible adhesive layer of the tape in the guide means;

(d) fusible adhesive actuator means normally positioned above the tape in the guide means; and (e) means for engaging the fusible adhesive actuating means with the tape at a point opposite the location of the raised anvil to clamp the tape and the fabric segment between the anvil and the fusible adhesive actuator means thereby actuating the fusible adhesive of the tape to bond the fabric segment to the tape;

tape advancing means positioned at a third point along the guide means downstream from the second point and comprising:

(a) opposed jaws positioned on opposite sides of the tape in the guide means;

(b) means for actuating the jaws to clamp the tape therebetween;

(c) means for moving the jaws and the tape clamp therebetween along the path of the tape in the guide means from the third point to a fourth point along the guide means downstream from the third point, the distance between the third and fourth points being indexed to provide a uniform separation between the fabric segments on the tape;

means for releasing the clamping means when the tape advancing means is actuated to move the tape and the fabric segments attached thereto toward the take-up reel;

trimming means located at a fifth point along the path of the tape in the guide means downstream from the fourth point for cutting fabric segments secured to the tape to a predetermined size, the distance between the fifth and fourth points being an integer multiple of the distance between the third and fourth points so that as the tape is moved to receive a fabric segment at the fabric attachment means, a fabric segment is moved into the trimming means;

adhesive depositing means located at a sixth point along the path of the tape in the guide means downstream from the fifth point for depositing adhesive onto the upper surface of trimmed fabric segments secured to the tape, the distance between the sixth and fifth points being an integer multiple of the distance between the third and fourth points so that as the tape is moved to receive a fabric segment at the fabric attachment means, a fabric segment is moved into the adhesive depositing means; and folding means located at a seventh point along the path of the tape in the guide means downstream from the sixth point for folding a portion of each trimmed fabric segment into engagement with the adhesive previously deposited on the upper surface of the fabric segment to form a pocket welt, the distance between the seventh and sixth points being an integer multiple of the distance between the third and fourth points so that as the tape is moved to receive a fabric segment at the fabric attachment means, a fabric segment is moved into the folding means.

10. The apparatus according to claim 9 wherein the clamping means comprises:

a fixed member located on one side of the tape in the guide means;

a movable member mounted on the opposite side of the tape in the guide means; and fluid powered cylinder means for actuating the movable member to clamp the tape between the movable member and the fixed member.

11. The apparatus according to claim 9 wherein the means for raising the anvil and thereby lifting the fabric segment upwardly into engagement with the fusible adhesive layer on the tape in the guide means comprises fluid powered cylinder means.

12. The apparatus according to claim 9 wherein the fusible adhesive actuator means includes electrically powered heating means for actuating the fusible adhesive layer of the tape.

13. The apparatus according to claim 9 wherein the means for engaging the fusible adhesive actuator means with the tape at a point opposite the location of the raised anvil includes fluid powered cylinder means.

14. The apparatus according to claim 9 wherein the means for actuating the jaws of the tape advancing means comprises fluid powered cylinder means.

15. The apparatus according to claim 9 wherein the means for moving the jaws and the tape clamped therebetween of the tape advancing means comprises:

guide means supporting the jaws for movement between the third and fourth points along the path; and fluid powered cylinder means for moving the jaws back and forth along the guide means.

16. The apparatus according to claim 9 wherein the trimming means comprises fixed and movable sheering edges positioned adjacent the tape path for receiving each fabric segment therebetween and means for selectively moving the movable sheering edge relative to the fixed sheering edge to cut each fabric segment.

17. The apparatus according to claim 9 wherein the adhesive depositing means comprises means for transferring a predetermined quantity of fusible adhesive from an adhesive transporting tape onto the upper surface of each trimmed fabric segment.

18. The apparatus according to claim 17 further including means for actuating the deposited fusible adhesive to secure the folded portion of each trimmed fabric segment in engagement with the surface thereof upon which the fusible adhesive was deposited.

19. The apparatus according to claim 9 wherein:

the clamping means comprises a fixed member located on one side of the path of the tape in the guide means, a movable member located on the opposite side of the path of the tape in the guide means, and fluid powered cylinder means for actuating the movable member to clamp the tape between the movable member and the fixed member;

the means for raising the anvil comprises fluid powered cylinder means;

the fusible adhesive actuator means includes electrically powered heating means;

the means for engaging the fusible adhesive actuator means with the tape includes fluid powered cylinder means;

the jaws actuating means of the tape advancing means includes fluid powered cylinder means; and the means for moving the jaws of the tape advancing means includes guide means supporting the jaws for movement between the third and fourth points along the path of the tape of the guide means, and fluid powered cylinder means for moving the jaws back and forth along the guide means;

the trimming means comprises cooperating sheering edges positioned adjacent a tape path for receiving each fabric segment therebetween, and means for actuating the cooperating sheering edges to cut each fabric segment to the predetermined size;

the adhesive depositing means comprises means for depositing a predetermined quantity of thermal adhesive onto the upper surface of each fabric segment; and means for actuating the thermal adhesive deposited on each fabric segment to secure the folded portion of the fabric segment in engagement with the surface having the thermal adhesive deposited thereon.

* * * * *